US011254140B2

(12) United States Patent
Katayama et al.

(10) Patent No.: US 11,254,140 B2
(45) Date of Patent: Feb. 22, 2022

(54) LIQUID DISCHARGE HEAD

(71) Applicant: Brother Kogyo Kabushiki Kaisha, Nagoya (JP)

(72) Inventors: Hiroshi Katayama, Toyoake (JP); Shohei Koide, Nagoya (JP); Keita Sugiura, Toyokawa (JP); Keita Hirai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/881,476

(22) Filed: May 22, 2020

(65) Prior Publication Data

US 2020/0391509 A1 Dec. 17, 2020

(30) Foreign Application Priority Data

Jun. 12, 2019 (JP) ..... JP2019-109784

(51) Int. Cl.
*B41J 2/18* (2006.01)
*B41J 2/14* (2006.01)
*B41J 2/19* (2006.01)

(52) U.S. Cl.
CPC ..... *B41J 2/18* (2013.01); *B41J 2/14233* (2013.01); *B41J 2/19* (2013.01); *B41J 2002/14306* (2013.01); *B41J 2002/14419* (2013.01); *B41J 2202/12* (2013.01)

(58) Field of Classification Search
CPC ... B41J 2/18; B41J 2/19; B41J 2/14233; B41J 2002/14419; B41J 2202/12; B41J 2002/14306
See application file for complete search history.

(56) References Cited

U.S. PATENT DOCUMENTS

2017/0096015 A1 4/2017 Odaka et al.
2018/0272743 A1* 9/2018 Nakai ..... B41J 2/19

FOREIGN PATENT DOCUMENTS

JP 2017-065249 A 4/2017

* cited by examiner

*Primary Examiner* — Geoffrey S Mruk
(74) *Attorney, Agent, or Firm* — Banner & Witcoff, Ltd.

(57) ABSTRACT

A liquid discharge head includes: first and second common channels extending in a first direction; and individual channels including pressure chambers and nozzles. Each of the individual channels includes: a supply portion; a descender portion extending in a second direction; and a return portion extending in a third direction. The return portion includes: a throttle portion; and a wide portion. Each of the nozzles overlaps with the wide portion. A relationship of L2>L1 is satisfied, wherein L1 is a distance in the third direction from a center of each of the nozzles to a throttle starting position, and L2 is a distance in the third direction passing through a center in a cross section of the descender portion and ranging from a center line parallel to the second direction to the center of each of the nozzles.

9 Claims, 6 Drawing Sheets

LIQUID DISCHARGE HEAD

CROSS REFERENCE TO RELATED APPLICATION

The present application claims priority from Japanese Patent Application No. 2019-109784 filed on Jun. 12, 2019, the disclosure of which is incorporated herein by reference in its entirety.

BACKGROUND

Field of the Invention

The present disclosure relates to a liquid discharge head configured to discharge a liquid, such as ink, on a medium.

Description of the Related Art

As a liquid discharge head configured to discharge a liquid, there is known a circulate-type ink-jet head. For example, in a publicly-known ink-jet head, ink that flows out of a common liquid chamber passes through an individual liquid chamber (pressure chamber) and a nozzle channel (descender channel), and is discharged from a nozzle. Ink that is not discharged from the nozzle passes through a discharge channel to flow into a circulation common liquid chamber. Causing ink to flow through the vicinity of the nozzle as described above inhibits the drying of ink in the vicinity of the nozzle.

In the above publicly-known ink-jet head, the discharge channel includes a circulation liquid chamber connected to the nozzle channel that extends in an up-down direction and extending in a horizontal direction, and a resistance portion having a channel cross-sectional area smaller than that of the circulation liquid chamber. In order to efficiently stir or agitate the ink in the nozzle by the ink flowing through the vicinity of the nozzle, in the well known ink-jet head, the nozzles are disposed such that at least part each nozzle is disposed to overlap in the up-down direction with the nozzle channel corresponding thereto.

SUMMARY

There is known that the circulation-type ink-jet head is capable of not only inhibiting the drying of ink in the vicinity of the nozzle but also removing air, which enters the ink-jet head from the nozzle, by using the ink flow. The inventors of the present application have found by earnest investigation that air entering from the nozzle(s) has difficulty in being discharged by the ink flow in the vicinity of the nozzle(s) when the nozzles are arranged in the above configuration, and the inventors arrived at the present disclosure.

An object of the present disclosure is to provide a circulation-type liquid discharge head in which air entering from a nozzle is easily discharged from the nozzle by ink flow in the vicinity of the nozzle.

According to an aspect of the present disclosure, there is provided a liquid discharge head, including: a first common channel extending in a first direction; a second common channel extending in the first direction; and a plurality of individual channels including a plurality of pressure chambers arranged in the first direction and a plurality of nozzles arranged in the first direction. Each of the individual channels includes: a supply portion that causes the first common channel to communicate with one of the pressure chambers; a descender portion extending in a second direction that intersects with the first direction and causing one of the pressure chambers positioned at an upstream side in the second direction to communicate with one of the nozzles positioned at a downstream side in the second direction; and a return portion branching from the descender portion and extending in a third direction, which intersects with the first direction and the second direction, to communicate with the second common channel, the return portion including: a throttle portion and a wide portion. A downstream end of the throttle portion in the third direction is connected to the second common channel. An upstream end of the wide portion in the third direction is connected to the descender portion and a downstream end of the wide portion in the third direction is connected to the throttle portion. A cross-sectional area in a plane perpendicular to the third direction of the wide portion is larger than that of the throttle portion. Each of the nozzles overlaps in the second direction with the wide portion. A relationship of L2>L1 is satisfied, wherein L1 is a distance in the third direction from a center of each of the nozzles to a throttle starting position that is a connection position between the throttle portion and the wide portion, and L2 is a distance in the third direction passing through a center in a cross section orthogonal to the second direction of the descender portion and ranging from a center line parallel to the second direction to the center of each of the nozzles.

In the above configuration, the distance L1 in the third direction from the center of each of the nozzles to the throttle starting position that is the connection position between the throttle portion and the wide portion is shorter than the distance L2 in the third direction passing through the center in the cross-section orthogonal to the second direction of the descender portion and ranging from the center line parallel to the second direction to the center of each of the nozzles. This inhibits or reduces a liquid flow component flowing toward the downstream side in the second direction in the position that is upstream from the nozzle in the second direction. Thus, even when air enters from the nozzle, in the position upstream from the nozzle in the second direction, the flowing of liquid toward the downstream side in the second direction inhibits air from staying in the position upstream from the nozzle in the second direction, and air can be removed efficiently.

DESCRIPTION OF THE EMBODIMENTS

<Schematic Configuration of Printer>

Figure 1:
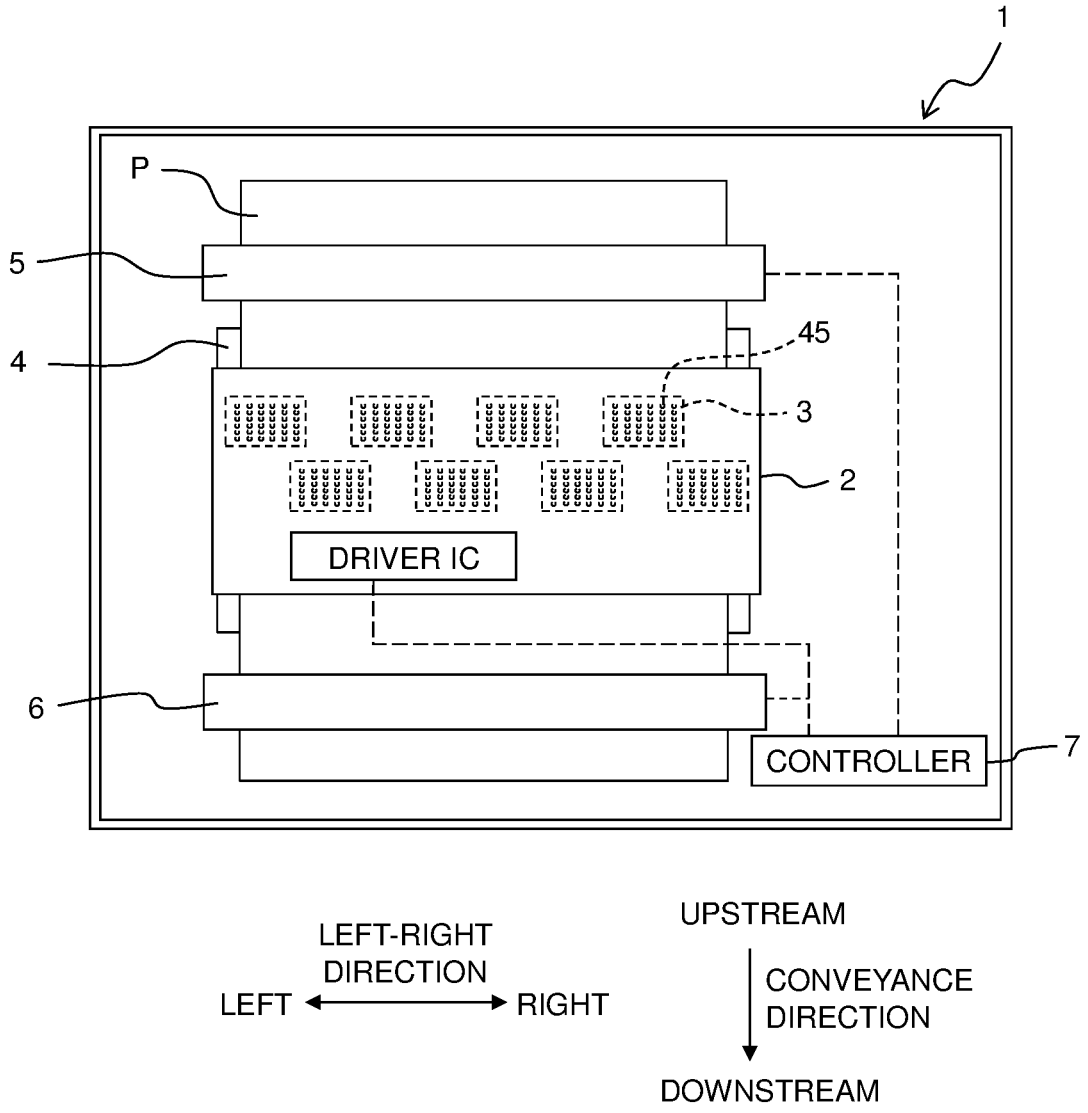
FIG. 1 is a schematic plan view of an ink-jet printer.

As depicted in FIG. 1, a printer 1 according to an embodiment of the present disclosure mainly includes an ink-jet head 2, head units 3, a platen 4, conveyance rollers 5 and 6, and a controller 7. In FIG. 1, a direction in which a recording sheet P is conveyed is defined as a conveyance direction. An upstream side and a downstream side in the conveyance direction are as indicated in FIG. 1. In FIG. 1, a sheet width direction of the conveyed recording sheet P is defined as a left-right direction. A right side and a left side in the left-right direction are as indicated in FIG. 1. The conveyance direction and the left-right direction are parallel to a horizontal plane, and the conveyance direction is orthogonal to the left-right direction.

The ink-jet head 2 is a line-type ink-jet head. The ink-jet head 2 includes eight head units 3. As described below, the ink-jet head 2 is a circulation-type ink-jet head. As depicted in FIG. 1, the eight head units 3 are arranged zigzag in the conveyance direction and the left-right direction. Each head unit 3 discharges ink from nozzles 45 formed in a lower surface thereof. The ink-jet head 2 includes a driver IC 8. As described below, ink is discharged from a desired nozzle 45 included in the nozzles 45 by the control of the driver IC 8 performed by the controller 7.

The platen 4 is disposed to face a lower surface of the ink-jet head 2. The platen 4 extends in the left-right direction over an entire length in the sheet width direction of the recording sheet P. The platen 4 supports the recording sheet P from below. The conveyance roller 5 is disposed upstream of the recording sheet P in the conveyance direction, and the conveyance roller 6 is disposed downstream of the recording sheet P in the conveyance direction. The recording sheet P is conveyed in the conveyance direction by use of the conveyance rollers 5 and 6.

In the printer 1, the controller 7 controls a motor (not depicted) provided in the conveyance rollers 5, 6 so that the recording sheet P is conveyed in the conveyance direction by a predefined distance by use of the conveyance rollers 5, 6. The controller 7 controls the ink-jet head 2 to discharge ink from the nozzles 45 every time the recording sheet P is conveyed. Accordingly, the printer 1 performs printing on the recording sheet P.

<Head Units 3>

Figure 2:
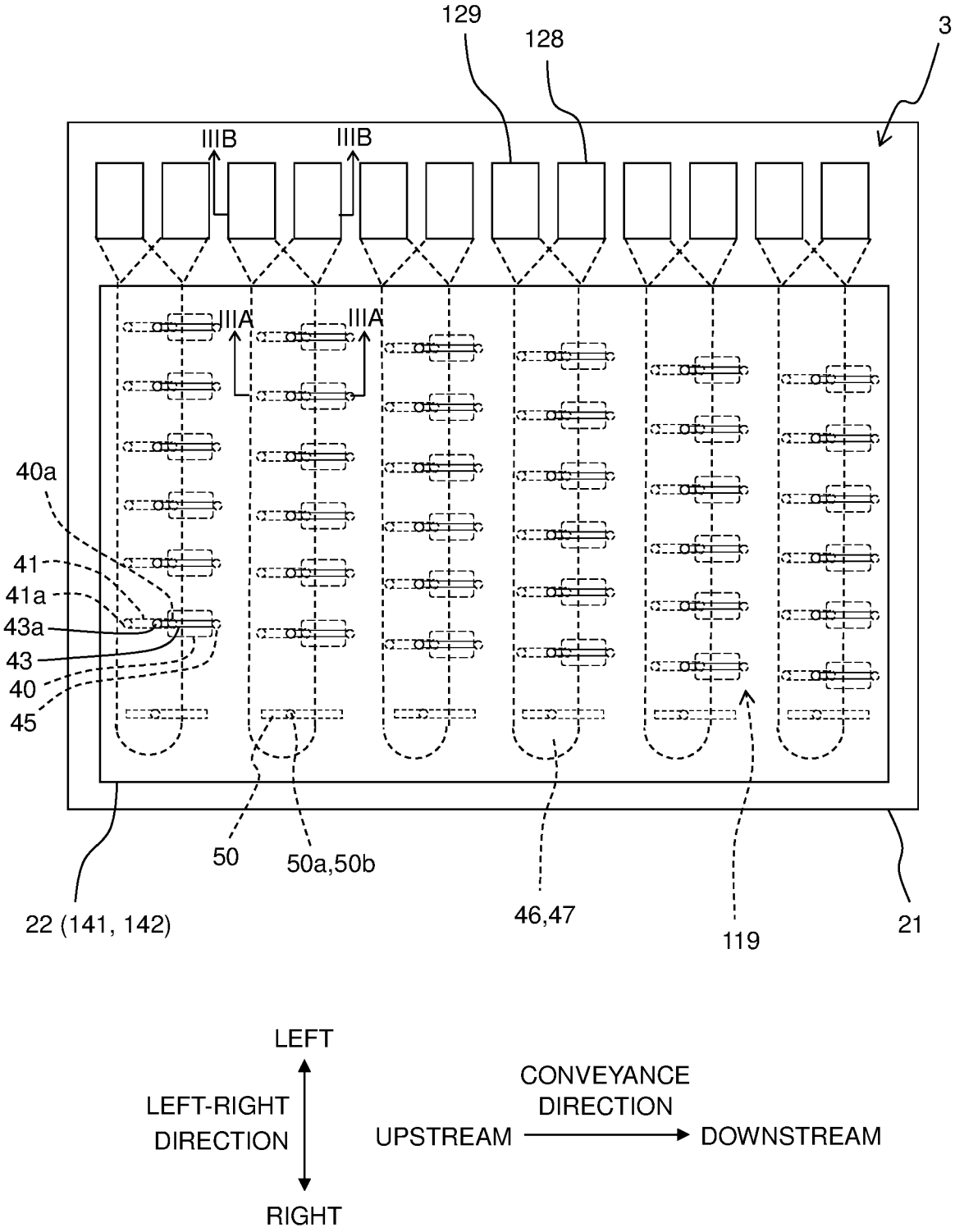
FIG. 2 is a plan view of an ink-jet head.
Figure 3A:
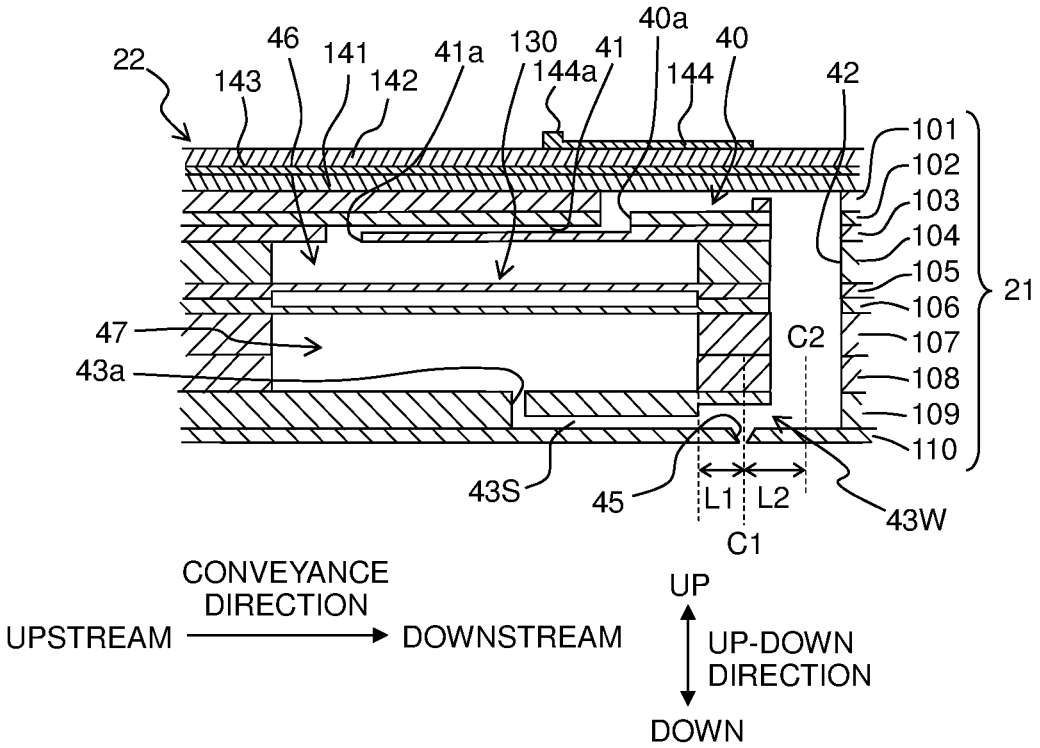
FIGS. 3A and 3B are schematic cross-sectional views of the ink-jet head according to the first embodiment.

The head units 3 of the ink-jet head 2 are explained below. As depicted in FIGS. 2 and 3A, each head unit 3 includes a channel unit 21 formed having ink channels, such as the nozzles 45 and pressure chambers 40, and a piezoelectric actuator 22 that applies pressure to ink in the pressure chambers 40.

<Channel Unit 21>

Figure 3B:
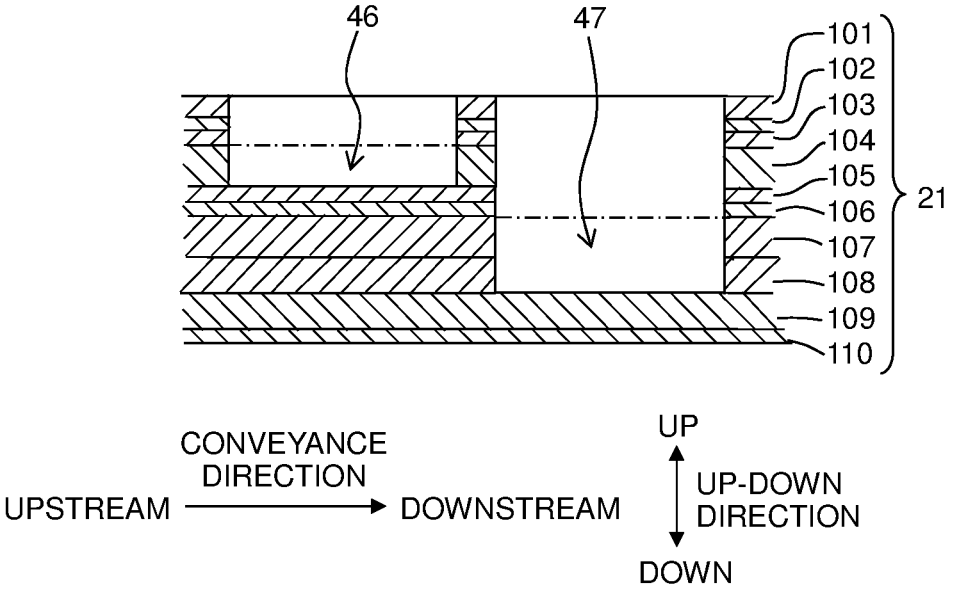

As depicted in FIGS. 3A and 3B, the channel unit 21 includes ten plates 101 to 110 stacked on top of each other in an up-down direction. The up-down direction corresponds to a second direction of the present disclosure. As depicted in FIG. 2, the channel unit 21 includes six supply manifolds 46, six return manifolds 47, individual channels 30, and the pressure chambers 40 and the nozzles 45 formed in the individual channels 30. Each individual channel 30 includes a supply portion 41, a descender portion 42 (see FIG. 3A), and a return portion 43. For easy understanding of FIG. 2, the return portions 43 are depicted by solid lines.

The plate 101 is formed having the pressure chambers 40. Each pressure chamber 40 has a substantially rectangular shape that is long in the conveyance direction. The pressure chambers 40 form six pressure chamber rows 119 arranged in the conveyance direction. Each pressure chamber row 119 extends in the left-right direction. The positions in the left-right direction of the pressure chambers 40 belonging to one of the adjacent two pressure chamber rows 119 are different from those belonging to the other.

The supply portions 41 extend over the plates 102 and 103. Each of the supply portions 41 connects one of the pressure chambers 40 and one of the supply manifolds 46. A first end of the supply portion 41 is connected to the pressure chamber 40 through an opening 40*a* formed at an upstream end in the conveyance direction of the pressure chamber 40. A second end of the supply portion 41 is connected to the supply manifold 46 through a supply opening 41*a* (an example of a supply opening of the present disclosure). A cross-sectional area of the supply portion 41 is smaller than a cross-sectional area of the descender portion 42. The supply portion 41 is connected to the upstream end in the conveyance direction of the pressure chamber 40. The supply portion 41 extends from the connection portion with the pressure chamber 40 toward the upstream side in the conveyance direction.

The descender portions 42 are formed by overlapping through holes in the plates 102 to 109 with one another in the up-down direction. Each of the descender portions 42 is part of a channel that connects one of the pressure chambers 40 and one of the nozzles 45. The descender portion 42 extends downward from a downstream end in the conveyance direction of the pressure chamber 40. A lower end of the descender portion 42 is connected to the return portion 43 extending in the conveyance direction.

The return portions 43 are formed in the plate 109. Each of the return portions 43 connects one of the descender portions 42 and one of the return manifolds 47. The return portion 43 extends toward the upstream side in the conveyance direction from a connection portion with the descender portion 42 formed in the plate 109. Further, the return portion 43 is connected to the return manifold 47 through a return opening 43*a* (an example of a return opening of the present disclosure) formed in the plate 109. An opening area of the return opening 43*a* is larger than an opening area of the supply opening 41*a*. The return portion 43 has a wide portion 43W and a throttle portion 43S. A length H1 (hereinafter also referred to as a height H1) in the up-down direction of the wide portion 43W is larger than a height H2 of the throttle portion 43S (see FIG. 4A). In this embodiment, the height H1 of the wide portion 43W is approximately 30 μm, and the height H2 of the throttle portion 43S is approximately 15 μm. Namely, the height H1 of the wide portion 43W is twice the height H2 of the throttle portion 43S.

Figure 4A:
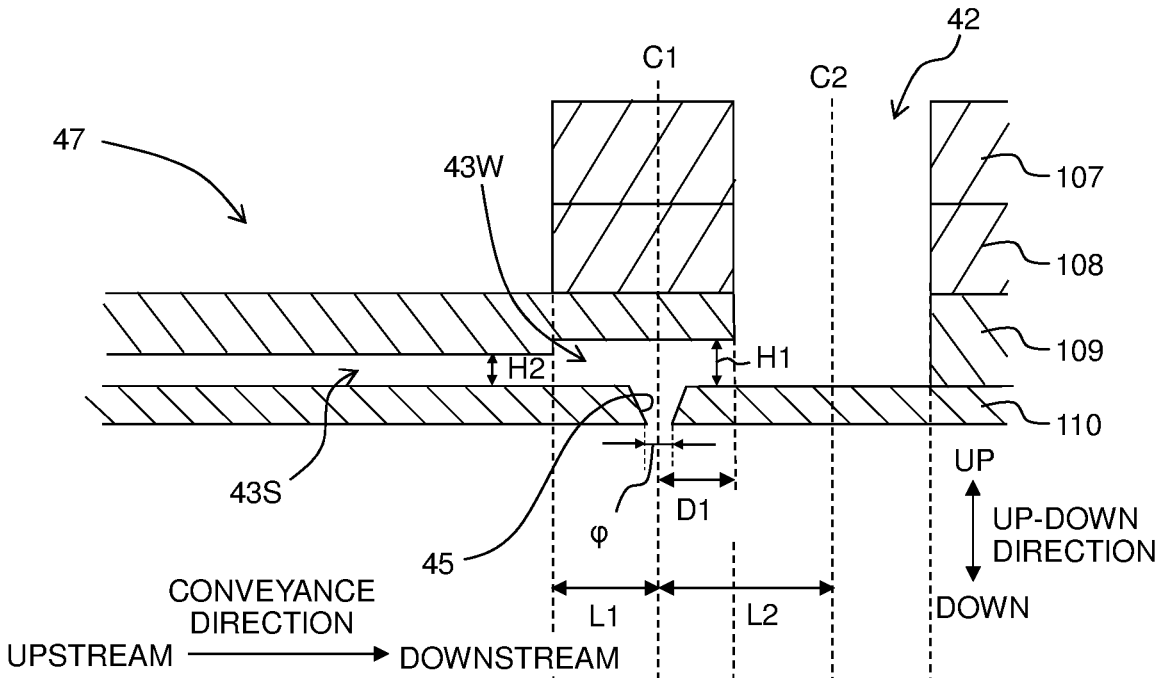
FIG. 4A is a partial enlarged view of FIG. 3A.
Figure 4B:
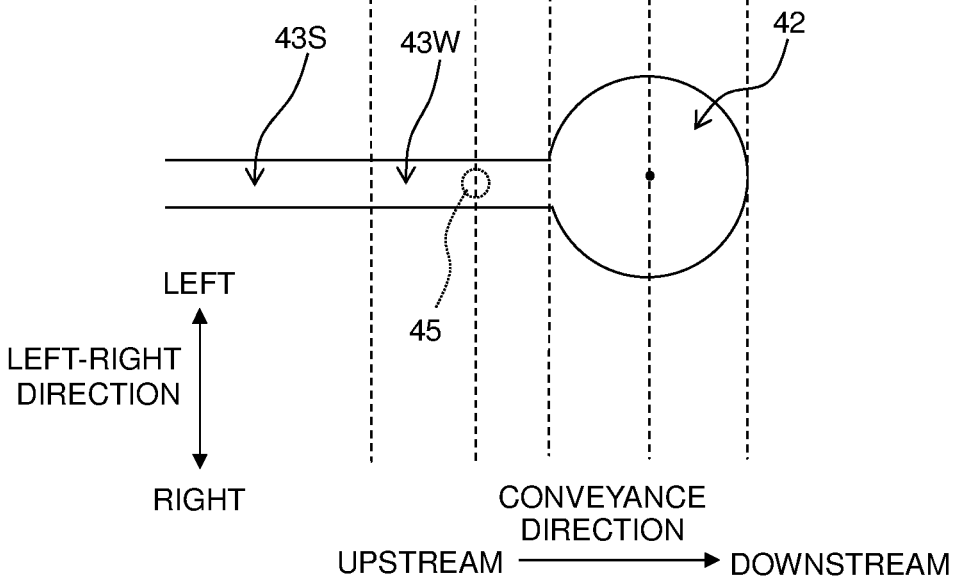
FIG. 4B is a top view of FIG. 4A.

As depicted in FIGS. 3A and 4A, the nozzles 45 are formed in the plate 110 at positions overlapping in the up-down direction with the wide portions 43W. As depicted in FIG. 4A, a distance L1 in the conveyance direction from a boundary between the wide portion 43W and the throttle portion 43S to a center line C1 of the nozzle 45 is shorter than a distance L2 in the conveyance direction from the center line C1 of the nozzle 45 to a center line C2 of the descender portion 42 (L1<L2). Further, a distance D1 from a boundary between the wide portion 43W and the descender portion 42 to the center line C1 of the nozzle 45 is shorter than the distance L1 from the boundary between the wide portion 43W and the throttle portion 43S to the center line C1 of the nozzle 45 (D1<L1). In this embodiment, the distance L2 in the conveyance direction from the center line C1 of the nozzle 45 to the center line C2 of the descender portion 42 is twice the distance L1 from the boundary between the wide portion 43W and the throttle portion 43S to the center line C1 of the nozzle 45. An inner diameter φ of the nozzle 45 is larger than a height of the level difference between the wide portion 43W and the throttle portion 43S (H1−H2). The inner diameter φ of the nozzle 45 is defined as a diameter of an opening in a lower surface of the plate 110. In this embodiment, the inner diameter φ of the nozzle 45 is approximately 17 μm, and the height of the level difference between the wide portion 43W and the throttle portion 43S (H1−H2) is approximately 15 μm. The distance L1 in the conveyance direction from the boundary between the wide portion 43W and the throttle portion 43S to the center line C1 of the nozzle 45 is 70 to 80 μm. The distance L2 in the conveyance direction from the center line C1 of the nozzle 45 to the center line C2 of the descender portion 42 is 120 to 130 μm. The distance D1 from the boundary between the wide portion 43W and the descender portion 42 to the center line C1 of the nozzle 45 is 10 to 20 μm.

As depicted in FIG. 3A, the supply manifolds 46 are formed in the plate 104. As depicted in FIG. 2, the six supply manifolds 46 extending in the left-right direction are arranged in the conveyance direction at intervals. The six supply manifolds 46 correspond to the six pressure chamber rows 119. Each supply manifold 46 is connected to the pressure chambers 40 forming the corresponding pressure chamber row 119 via the supply portions 41. A supply port 128 is provided at a left end in the left-right direction of each supply manifold 46. The ink in the ink tank (not depicted) is supplied from the supply port 128 to the supply manifold 46. In that configuration, ink flows through the supply manifold 46 from the left side to the right side in the left-right direction, and then supplied to the respective pressure chambers 40 via the respective supply portions 41.

As depicted in FIG. 3A, the return manifolds 47 are formed in the plates 107 and 108. As depicted in FIG. 2, the six return manifolds 47 extending in the left-right direction are arranged in the conveyance direction at intervals. A recovery port 129 is provided at a left end in the left-right direction of each return manifold 47. The recovery ports 129 are connected to the ink tank (not depicted). As depicted in FIGS. 3A and 3B, the return manifolds 47 are positioned below the supply manifolds 46 to overlap in the up-down direction with the supply manifolds 46. The six return manifolds 47 correspond to the six pressure chamber rows 119. Each return manifold 47 is connected the pressure chambers 40 forming the corresponding pressure chamber row 119 via the descender portions 42 and the return portions 43. Ink not discharged from the nozzles 45 flows into each return manifold 47 from the return portions 43 of the individual channels 30, flows through the return manifold 47 from the right side to the left side in the left-right direction, and is recovered through the recovery port 129. Ink flowing out of each recovery port 129 returns to the ink tank (not depicted).

As depicted in FIG. 2, coupling channels 50 coupling the supply manifolds 46 with the return manifolds 47 are formed at right ends in the left-right direction of the supply manifolds 46 and the return manifolds 47. Since each coupling channel 50 has the same shape as the individual channel 30 except that the coupling channel 50 does not communicate with the nozzle 45, detail explanation thereof is omitted.

A pump (not depicted) is provided in a channel connecting each supply port 128 and the ink tank or in a channel connecting each recovery port 129 and the ink tank. The flowing of ink caused by driving the pump (not depicted) circulates ink between the ink-jet head 2 and the ink tank (not depicted). In this embodiment, the pressure applied to ink flowing through the supply manifold 46 is larger than the pressure applied to ink flowing through the return manifold 47. This generates the flowing of ink from the supply manifold 46 to the return manifold 47.

The channel unit 21 includes dampers 130 that extend over a lower portion of the plate 105 and an upper portion of the plate 106 and overlap in the up-down direction with the supply manifolds 46 and the return manifolds 47. The pressure fluctuation of the ink in each supply manifold 46 is inhibited by deforming a partition wall, which is formed by a lower end of the plate 106 to separate the supply manifold 46 from the dumper 130. The pressure fluctuation of the ink in each return manifold 47 is inhibited by deforming a partition wall, which is formed by an upper end of the plate 105 to separate the return manifold 47 from the dumper 130.

<Piezoelectric Actuator>

As depicted in FIG. 3A, the piezoelectric actuator 22 includes two piezoelectric layers 141 and 142, a common electrode 143, and individual electrodes 144. The piezoelectric layers 141 and 142 are made using a piezoelectric material. For example, it is possible to use a piezoelectric material composed primarily of lead zirconate titanate (PZT), which is a mixed crystal of lead titanate and lead zirconate. The piezoelectric layer 141 is disposed on an upper surface of the channel unit 21. The piezoelectric layer 142 is disposed on an upper surface of the piezoelectric layer 141. The piezoelectric layer 141 may be made using any other insulating material than the piezoelectric material.

The common electrode 143 is disposed between the piezoelectric layer 141 and the piezoelectric layer 142. The common electrode 143 continuously extends over an entire area of the piezoelectric layers 141 and 142. The common electrode 143 is kept at a ground potential. Each of the individual electrodes 144 is provided for the corresponding one of the pressure chambers 40. Each individual electrode 144 has a substantially rectangular planar shape. Each individual electrode 144 is disposed to overlap in the up-down direction with a center portion of the corresponding pressure chamber 40. Connection terminals 144*a* of the individual electrodes 144 are connected to the driver IC8 (see FIG. 1) via trace members (not depicted). The driver IC8 selectively applies any of the ground potential and a driving potential to the respective individual electrodes 144. Corresponding to the arrangement of the common electrode 143 and the individual electrodes 144 as described above, a portion of the piezoelectric layer 142 interposed between the common electrode 143 and each individual electrode 144 is an active portion polarized in a thickness direction.

A method for discharging ink from a certain nozzle 45 included in the nozzles 45 by driving the piezoelectric actuator 22 is explained. In this embodiment, ink is discharged using a so-called pull ejection as described below. The following control is executed by the controller 7 (see FIG. 1). The controller 7 controls the driver IC 8 so that the driver IC 8 controls the electric potential of the common electrode 143 and the electric potential of each individual electrode 144. When the piezoelectric actuator 22 is in a standby state where no ink is discharged from the nozzle 45, the piezoelectric actuator 22 is kept at the ground potential that is the same as the common electrode 143, and all the individual electrodes 144 are kept at the driving potential different from the ground potential. In that situation, a portion of the piezoelectric layers 141 and 142 overlapping in the up-down direction with the pressure chamber 40 is deformed so that the portion becomes convex toward the pressure chamber 40 as a whole.

When ink is discharged from the certain nozzle 45, the electric potential of the individual electrode 144 corresponding to the certain nozzle 45 is switched to the ground potential. This eliminates the deformation of the portion of the piezoelectric layers 141 and 142 overlapping in the up-down direction with the pressure chamber 40, increasing the volume of the piezoelectric chamber 40. Then, switching the electric potential of the individual electrode 144 to the driving potential deforms the portion of the piezoelectric layers 141 and 142 overlapping in the up-down direction with the pressure chamber 40 so that the portion becomes convex toward the pressure chamber 40. This increases the pressure of ink in the pressure chamber 40 to discharge ink from the nozzle 45 communicating with the pressure chamber 40. The electric potential of the individual electrode 144 is maintained at the driving potential even after ink is discharged from the nozzle 45.

<Regarding Flowing of Ink in Wide Portion 43W>

Figure 5:
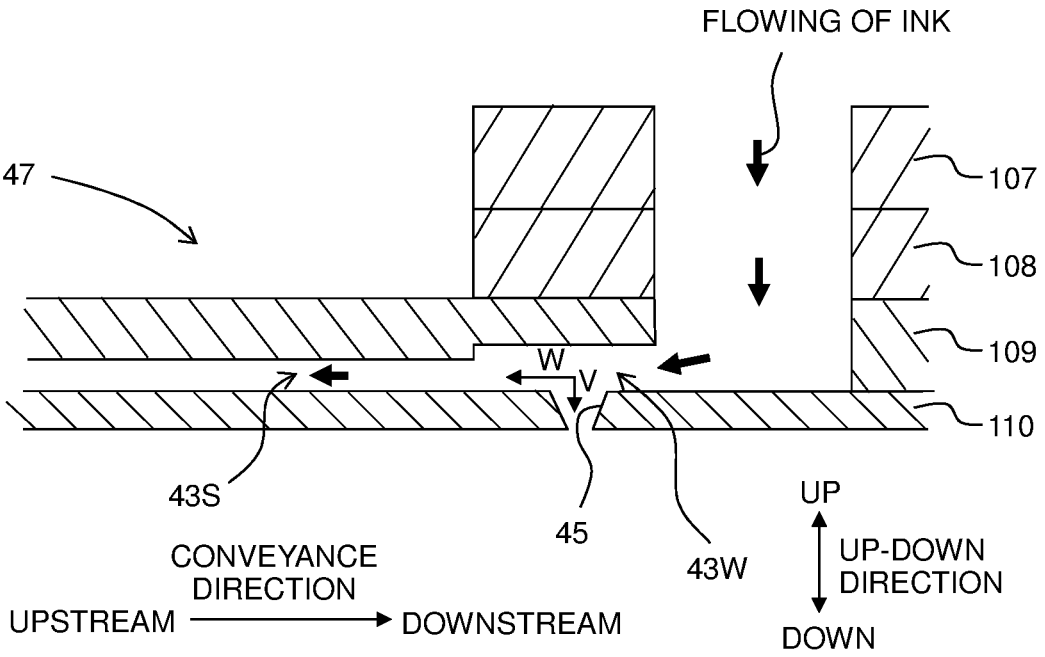
FIG. 5 is a schematic diagram for illustrating a flow velocity of ink flowing through a channel.

Referring to FIG. 5, flowing of ink from the descender portion 42 to the wide portion 43W is considered. A ratio of a flow velocity component W of the ink flowing through a certain position toward an upstream side in the conveyance direction (hereinafter simply referred to as a horizontal (lateral) flow velocity component W) to a flow velocity component V of the ink flowing through the certain position toward a downstream side in the conveyance direction (hereinafter simply referred to as a downward flow velocity component V) is defined as a flow velocity ratio R (=W/V) at that position. For example, at a substantially center portion in the up-down direction of the descender portion 42, ink flows downward in the up-down direction. Thus, the horizontal flow velocity component W is much smaller than the downward flow velocity component V. In other words, the flow velocity ratio R is a value close to zero. On the other hand, in the vicinity of the boundary between the descender portion 42 and the wide portion 43, an ink flowing direction is gradually changed from the downward direction in the up-down direction to the horizontal direction. Along with this, the downward flow velocity component V is gradually smaller, and the horizontal flow velocity component W is gradually larger. Namely, the flow velocity ratio R is gradually larger. Since ink flows horizontally (laterally) through the descender portion 43S, the horizontal flow velocity component W is much larger than the downward flow velocity component V. This makes the flow velocity ratio R in the descender portion 43S much larger than the flow velocity ratio R in the vicinity of the boundary between the descender portion 42 and the wide portion 43. An exemplary downward flow velocity component V and an exemplary horizontal flow velocity component W in a position of the wide portion 43W overlapping in the up-down direction with each nozzle 45 (hereinafter referred to as a position immediately above the nozzle 45) are indicated below. An ink flow amount is approximately 230 nl/sec. Numerical values indicated below are merely examples. Like this embodiment, when the nozzle 45 does not overlap in the up-down direction with the descender portion 42 and the nozzle 45 is positioned at the upstream side in the conveyance direction from an upstream end in the conveyance direction of the descender portion 42 (the boundary between the descender portion 42 and the wide portion 43), in the position immediately above the nozzle 45, the downward flow velocity component V is approximately 0.2 mm/s and the horizontal flow velocity component W is approximately 35 mm/s. On this occasion, the flow velocity ratio R is approximately 175. Further, unlike this embodiment, when part of the nozzle 45 overlaps in the up-down direction of the upstream end in the conveyance direction of the descender portion 42 (the boundary between the descender portion 42 and the wide portion 43), in the position immediately above the nozzle 45, the downward flow velocity component V is approximately 1.1 mm/s and the horizontal flow velocity component W is approximately 29 mm/s. On this occasion, the flow velocity ratio R is approximately 26. Further, when the center portion of the descender portion 42 overlaps in the up-down direction with the nozzle 45, in the position immediately above the nozzle 45, the downward flow velocity component V is approximately 0.9 mm/s and the horizontal flow velocity component W is approximately 8.1 mm/s. On this occasion, the flow velocity ratio R is approximately 9.

As described above, in this embodiment, the nozzle 45 is provided in the wide portion 43W. In other words, at least part of the nozzle 45 is provided to overlap in the up-down direction with the wide portion 43W. For example, after ink is discharged, the meniscus of ink of the nozzle 45 may vibrate, which allows air to enter from the nozzle 45. When air bubbles caused by the air entering from the nozzle 45 exist in the channel, part of the pressure applied from the piezoelectric actuator 22 to discharge ink is consumed by contracting air bubbles. In this case, the pressure for discharging ink may become insufficient, and discharge failure may occur. The air bubbles caused by the air entering from the nozzle 45 are thus preferably removed as soon as possible. Especially, when air bubbles exist in the vicinity of the nozzle 45, the nozzle 45 is highly likely to have discharge failure. The air bubbles are thus required to be removed as soon as possible.

The ink-jet head 2 of this embodiment is a so-called circulate-type ink-jet head. In the ink-jet head 2 of this embodiment, air bubbles caused by the air entering from the nozzle 45 can be pushed toward the return manifold 47 by the ink flowing through the return portion 43 (wide portion 43W).

As described above, the flow velocity ratio R in the certain position is defined as the ratio of the horizontal flow velocity component W to the downward flow velocity component V in the certain position. Thus, the flow velocity ratio R is larger as the horizontal flow velocity component W is larger, and the flow velocity ratio R is larger as the downward flow velocity component V is smaller. When the downward flow velocity component V of ink is large in the vicinity of the nozzle 45, the downward ink flow pushes air bubbles caused by the air entering from the nozzle 45 from above. Thus, the possibility that air bubbles caused by the air entering from the nozzle 45 stay in the vicinity of the nozzle 45 is higher than a case in which the downward flow velocity component V is small. According to the study of the inventors, it is found out that the flow velocity ratio R in the position immediately above the nozzle 45 is preferably larger than 30 to efficiently push away the air bubbles caused by the air entering from the nozzle 45, toward the return manifold 47. Further, the inventors performed the simulation of ink flow and found out that making the distance L1 from the boundary between the wide portion 43W and the throttle portion 43S to the center line C1 of the nozzle 45 shorter in the conveyance direction than the distance L2 from the center line C1 of the nozzle 45 to the center line C2 of the descender portion 42 is effective to make the flow velocity ratio R large. The inventors found out, through further study, that making the distance L2 in the conveyance direction from the center line C1 of the nozzle 45 to the center line C2 of the descender portion 42 more than twice the distance L1 in the conveyance direction from the boundary between the wide portion 43W and the throttle portion 43S to the center line C1 of the nozzle 45 is further effective to make the flow velocity ratio R large. The inventors also studied the shapes of the descender channels, the wide portions, and the throttle portions as well as the arrangement of the nozzles based on the simulation of ink flow, and determined the shapes and the arrangement based on the simulation.

In this embodiment, as described above, the distance L2 in the conveyance direction from the center line C1 of the nozzle 45 to the center line C2 of the descender portion 42 is twice the distance L1 in the conveyance direction from the boundary between the wide portion 43W and the throttle portion 43S to the center line C1 of the nozzle 45. Further, the height H1 of the wide portion 43W is twice the height H2 of the throttle portion 43S. Further, the distance D1 from the boundary between the wide portion 43W and the descender portion 42 to the center line C1 of the nozzle 45 is shorter than the distance L1 from the boundary between the wide portion 43W and the throttle portion 43S to the center line C1 of the nozzle 45. In this embodiment, the flow velocity ratio R of the wide portion 43W in the position immediately above the nozzle 45 can be approximately 175 by adjusting the shapes of the descender portion 42, the wide portion 43W, and the throttle portion 43S as described above. In this case, the ink flow amount is approximately 230 nl/sec, and the removal percentage of air bubbles caused by the air entering from the nozzle 45 is 99.9%. Accordingly, it is possible to remove substantially all the air bubbles caused by the air entering from the nozzle 45. When the center portion of the descender portion 42 overlaps in the up-down direction with the nozzle 45 as described above, the flow velocity ratio R is approximately 9. On this occasion, the removal percentage of air bubbles caused by the air entering from the nozzle 45 is 88%.

The pressure wave generated in the pressure chamber 40 passes through the descender portion 42, moves toward the wide portion 43W, and then the throttle portion 43S. The pressure wave generated in the pressure chamber 40 is weaker with distance from the pressure chamber 40. The wide portion 43W is connected to the descender portion 42 at the downstream side in the conveyance direction. The cross-sectional area of the descender portion 42 is larger than that of the wide portion 43W. The wide portion 43W is connected to the throttle portion 43S at the upstream side in the conveyance direction. The cross-sectional area of the throttle portion 43S is smaller than that of the wide portion 43W. In the wide portion 43W, the pressure wave at the downstream side in the conveyance direction that is close to the pressure chamber 40 and the descender portion 42 is not weaker than the pressure wave at the upstream side in the conveyance direction that is close to the throttle portion 43S. In this embodiment, as described above, the distance D1 from the boundary between the wide portion 43W and the descender portion 42 to the center line C1 of the nozzle 45 is shorter than the distance L1 from the boundary between the wide portion 43W and the throttle portion 43S to the center line C1 of the nozzle 45. This inhibits the pressure wave at the position immediately above the nozzle 45 from becoming weak excessively, making it possible to inhibit the discharge failure of ink from the nozzle 45.

When the difference between the height H1 of the wide portion 43W and the height H2 of the throttle portion 43S is small, most of the pressure wave passing through the wide portion 43W escapes from the throttle portion 43S. In order to improve the force or power of discharging ink from the nozzle 45 provided in the wide portion 43W, the height H1 of the wide portion 43W is preferably more than twice the height H2 of the throttle portion 43S. In this embodiment, as described above, the height H1 of the wide portion 43W is twice the height H2 of the throttle portion 43S. This inhibits the decrease in the force or power of discharging ink from the nozzle 45 provided in the wide portion 43W.

Since air enters from the nozzle 45, the size of air bubbles may have substantially the same size as the inner diameter of the nozzle 45. In this embodiment, the inner diameter φ of the nozzle 45 is approximately 17 μm. When the difference in the height (H1−H2) between the wide portion 43W and the throttle portion 43S is larger than the size of air bubbles, the air bubbles may be caught by the height difference and may have difficulty in flowing toward the throttle portion 43S. Thus, as described above, in this embodiment, the inner diameter φ of the nozzle 45 is approximately 17 μm, and the difference in the height (H1−H2) between the wide portion 43W and the throttle portion 43S is approximately 15 μm. Accordingly, it is possible to inhibit the air bubbles from being caught by the height difference and having difficulty in flowing toward the throttle portion 43S.

The downward flow velocity component V in the up-down direction in the descender portion 42 is larger than the downward flow velocity component V in the up-down direction in the wide portion 43W. In view of this, the downward flow velocity component V in the up-down direction in an area overlapping in the up-down direction with an end in the conveyance direction of the descender portion 42 is larger than that in an area overlapping in the up-down direction with the wide portion 43W. Thus, in this embodiment, an entire area in the left-right direction of the nozzle 45 is in a position not overlapping in the up-down direction with an end in the left-right direction of the descender portion 42. In other words, each of the nozzles 45 does not overlap in the up-down direction with the corresponding one of the descender portions 42 at all. By positioning each of the nozzles 45 as described above, the downward ink flow inhibits air bubbles from staying in the vicinity of the nozzle 45.

<Modified Embodiments>

The above embodiment is just an example, and modifications may be made as appropriate. For example, it is possible to freely set the number of the pressure chambers as well as the arrangement, shape, pitch, and the like of the pressure chambers. Corresponding to this, it is possible to adjust the number of the individual electrodes and the nozzles as well as the arrangement, shape, pitch, and the like of the individual electrodes and the nozzles. Further, the inner diameter of the nozzles 45, the heights of the wide portion 43W and the throttle portion 43S, and the like in the above embodiment are just examples, and modifications may be made as appropriate without being limited thereto.

Figure 6A:
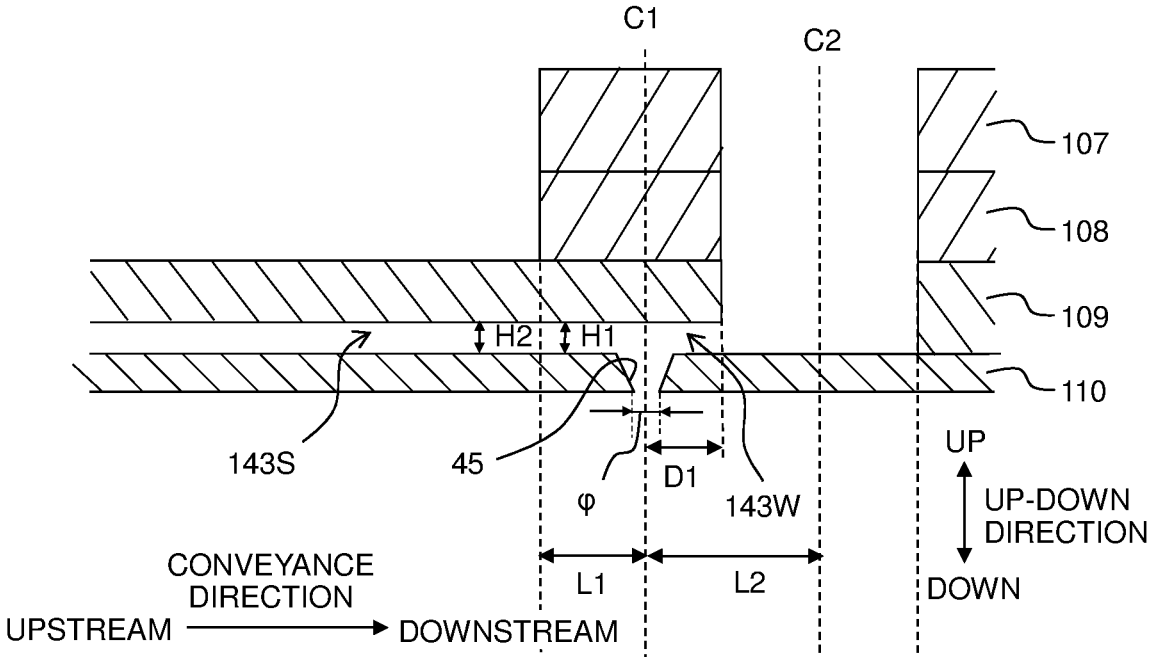
FIG. 6A is a diagram corresponding to FIG. 4A in a modified embodiment.
Figure 6B:
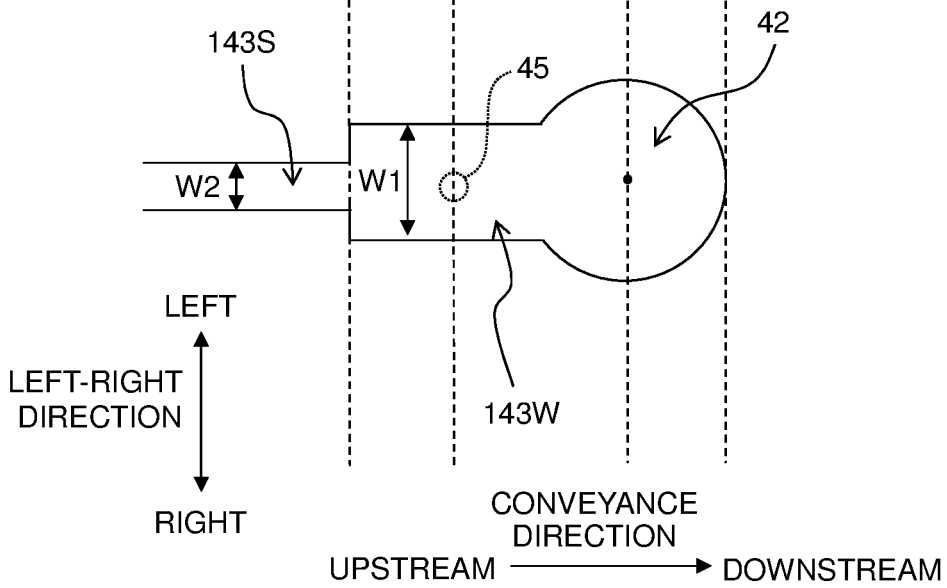
FIG. 6B is a diagram corresponding to FIG. 4B in the modified embodiment.

For example, in the above embodiment, the length (height) in the up-down direction of the wide portion 43W is longer than that of the throttle portion 43S. The present disclosure, however, is not limited to such an aspect. For example, as depicted in FIGS. 6A and 6B, a height H1 of a wide portion 143W may be the same as a height H2 of a throttle portion 143S. In this case, as depicted in FIG. 6B, a length (width W1) in the left-right direction of the wide portion 143W is longer than a length (width W2) in the left-right direction of the throttle portion 143S. In this case, an upper surface of the wide portion 143W is flush with an upper surface of the throttle portion 143S, and there is no height difference in the up-down direction. This eliminates the possibility that air bubbles caused by the air entering from the nozzle 45 are caught by the height difference in the up-down direction. In this case, the difference in height in the conveyance direction is generated at a boundary between the wide portion 143W and the throttle portion 143S. Thus, the length (W1−W2)/2 in the conveyance direction of this height difference may be smaller than the inner diameter Φ of the nozzle 45. For example, the length W1 in the left-right direction of the wide portion 143W may be approximately 140 to 160 μm, and the length W2 in the left-right direction of the throttle portion 143S may be approximately 70 to 80

μm. This inhibits air bubbles from being caught by the difference in height in the conveyance direction between the wide portion 143W and the throttle portion 143S. The length (height H1) in the up-down direction of the wide portion may be longer than the length (height H2) in the up-down direction of the throttle portion, and the length (width W1) in the conveyance direction of the wide portion may be longer than the length (width W2) in the conveyance direction of the throttle portion.

In the above embodiment, the ink-jet head is the line-type ink-jet head. The present disclosure, however, is not limited thereto. The present disclosure may be applied to a serial-type ink-jet head. The present disclosure is not limited to the ink-jet head discharging ink. The present disclosure is applicable to liquid discharge apparatuses used in a variety of kinds of usages other than printing of an image or the like. For example, the present disclosure is applicable to a liquid discharge apparatus configured to form a conductive pattern on a surface of a substrate by discharging a conductive liquid onto the substrate.

What is claimed is:

1. A liquid discharge head, comprising:

a first common channel extending in a first direction;

a second common channel extending in the first direction; and a plurality of individual channels including a plurality of pressure chambers arranged in the first direction and a plurality of nozzles arranged in the first direction, each of the individual channels including:

a supply portion that causes the first common channel to communicate with one of the pressure chambers;

a descender portion extending in a second direction that intersects with the first direction and causing one of the pressure chambers positioned at an upstream side in the second direction to communicate with one of the nozzles positioned at a downstream side in the second direction; and a return portion branching from the descender portion and extending in a third direction, which intersects with the first direction and the second direction, to communicate with the second common channel, the return portion including: a throttle portion and a wide portion, wherein a downstream end of the throttle portion in the third direction is connected to the second common channel, wherein an upstream end of the wide portion in the third direction is connected to the descender portion and a downstream end of the wide portion in the third direction is connected to the throttle portion, wherein a cross-sectional area in a plane perpendicular to the third direction of the wide portion is larger than that of the throttle portion, wherein each of the nozzles is located downstream of the upstream end of the wide portion in the third direction, each of the nozzles is located upstream of the downstream end of the wide portion in the third direction, and each of the nozzles overlaps in the second direction with the wide portion, and wherein a relationship of $$L2>L1>0$$

is satisfied, wherein L1 is a distance in the third direction from a center of each of the nozzles to a throttle starting position that is a connection position between the throttle portion and the wide portion, and L2 is a distance in the third direction from a center line of the descender portion to the center of each of the nozzles, wherein the center line of the descender portion passes through a center in a cross section orthogonal to the second direction of the descender portion and is parallel to the second direction.

2. The liquid discharge head according to claim 1, wherein a relationship of $$L2>2\times L1$$

is satisfied.

3. The liquid discharge head according to claim 1, wherein a relationship of $$W>30\times V$$

is satisfied, wherein W is a flow velocity of a liquid along the third direction at an upstream position in the second direction from the center of each of the nozzles, and V is a flow velocity of the liquid along the second direction at the upstream position in the second direction from the center of each of the nozzles.

4. The liquid discharge head according to claim 1, wherein, in the throttle starting position, an end surface at the upstream side in the second direction of the wide portion is flush with an end surface at the upstream side in the second direction of the throttle portion.

5. The liquid discharge head according to claim 1, wherein a relationship of $$D1<L1$$

is satisfied, wherein D1 is a distance in the third direction from an end surface at a downstream side in the third direction of the descender portion to each of the nozzles.

6. The liquid discharge head according to claim 1, wherein an end surface at a downstream side in the third direction of the descender portion is positioned at an upstream side in the third direction from each of the nozzles.

7. The liquid discharge head according to claim 1, wherein a relationship of $$H1\geq H2$$

is satisfied, wherein H1 is a length in the second direction from an end surface at the downstream side in the second direction of the wide portion to an end surface at the upstream side in the second direction of the wide portion, and H2 is a length in the second direction from an end surface at the downstream side in the second direction of the throttle portion to an end surface at the upstream side in the second direction of the throttle portion.

8. The liquid discharge head according to claim 1, wherein a relationship of $$\Phi>H1-H2$$

is satisfied, wherein Φ is an inner diameter of each of the nozzles, H1 is a length in the second direction from an end surface at the downstream side in the second direction of the wide portion to an end surface at the upstream side in the second direction of the wide portion, and H2 is a length in the second direction from an end surface at the downstream side in the second direction of the throttle portion to an end surface at the upstream side in the second direction of the throttle portion.

9. The liquid discharge head according to claim 1, wherein a downstream end of the descender portion in the second direction and the return portion are positioned at the downstream side in the second direction than both ends of the one of the pressure chambers in the second direction.

* * * * *